US006354252B1

(12) United States Patent
Rabhi

(10) Patent No.: US 6,354,252 B1
(45) Date of Patent: Mar. 12, 2002

(54) DEVICE FOR VARYING A PISTON ENGINE EFFECTIVE VOLUMETRIC DISPLACEMENT AND/OR VOLUMETRIC RATIO OF DURING ITS OPERATION

(76) Inventor: Vianney Paul Rabhi, 35 crs d'Herbouville, Lyons (FR)

( * ) Notice: Subject to any disclaimer, the term of this patent is extended or adjusted under 35 U.S.C. 154(b) by 0 days.

(21) Appl. No.: 09/423,291

(22) PCT Filed: May 7, 1998

(86) PCT No.: PCT/FR98/00918

§ 371 Date: Nov. 5, 1999

§ 102(e) Date: Nov. 5, 1999

(87) PCT Pub. No.: WO98/51911

PCT Pub. Date: Nov. 19, 1998

(30) Foreign Application Priority Data

May 9, 1997 (FR) ..... 97 05943
Apr. 7, 1998 (FR) ..... 98 04601

(51) Int. Cl.[7] ..... F02B 75/32

(52) U.S. Cl. ..... 123/78 BA; 123/48 B; 123/197.3

(58) Field of Search ..... 123/48 B, 78 BA, 123/78 E, 78 F, 197.4, 197.3, 197.1, 90.31, 90.12, 26, 302, 308, 432, 585, 48 A, 48 AA, 78 A, 78 AA

(56) References Cited

U.S. PATENT DOCUMENTS 1,434,146 A * 10/1922 Powell ..... 123/69 V
1,567,172 A * 12/1925 Powell ..... 74/29
1,636,612 A * 7/1927 Noah ..... 74/32
2,088,504 A * 7/1937 Brzezinski ..... 74/30
4,498,430 A * 2/1985 Giuliani et al. ..... 123/53.1
4,702,207 A * 10/1987 Hatamura et al. ..... 123/302
4,944,266 A * 7/1990 Hasegawa et al. ..... 123/302
5,136,987 A 8/1992 Schecter et al. ..... 123/48 B
5,159,904 A 11/1992 Ingold ..... 123/90.15
5,528,946 A * 6/1996 Yadegar ..... 74/31
5,546,914 A * 8/1996 Scheinert ..... 123/569
5,582,147 A * 12/1996 Kim ..... 123/302
5,673,665 A * 10/1997 Kim ..... 123/197.1
5,934,243 A * 8/1999 Kopystanski ..... 123/197.1
5,950,582 A * 9/1999 Stein ..... 123/90.15
5,957,096 A * 9/1999 Clarke et al. ..... 123/90.15
6,125,817 A * 10/2000 Piock et al. ..... 123/301

FOREIGN PATENT DOCUMENTS

| | | |
|---|---|---|
| CH | 651109 | 8/1985 |
| EP | 0337894 | 10/1989 |
| EP | 0520637 | 12/1992 |
| FR | 727994 | 6/1932 |
| FR | 1402509 | 10/1965 |
| GB | 15120 | * of 1899 |
| GB | 2206175 | 12/1988 |
| GB | 2245646 | 1/1992 |

* cited by examiner

*Primary Examiner*—Henry C. Yuen
*Assistant Examiner*—Hai Huynh
(74) *Attorney, Agent, or Firm*—Greenblum & Bernstein P.L.C.

(57) ABSTRACT

A device for varying an effective volumetric displacement and/or an effective volumetric ratio of an engine which comprises a piston and a cylinder, the device comprising a first device for controlling the effective volumetric ratio of the engine by modifying a starting point of a stroke of the piston with respect to the cylinder, and a second device for controlling the effective volumetric displacement of the engine by discharging into an inlet pipe excess gases let into the cylinder of the engine.

38 Claims, 7 Drawing Sheets

DEVICE FOR VARYING A PISTON ENGINE EFFECTIVE VOLUMETRIC DISPLACEMENT AND/OR VOLUMETRIC RATIO OF DURING ITS OPERATION

BACKGROUND OF THE INVENTION

1. Field of the Invention

The subject of the present invention is a device allowing the effective volumetric displacement and/or the effective volumetric ratio of a piston engine to be varied while it is running.

2. Background of the Invention and Related Art

The volumetric displacement of an engine usually denotes the geometric characteristics of said engine defined by the bore and the stroke. Here, we shall adopt the idea of effective volumetric displacement represented by the volume of gas at atmospheric pressure actually retained by the engine in order to perform each cycle.

In conventional parlance the volumetric ratio is also a geometric relationship between the volume of the chamber and the volume defined by the stroke multiplied by the bore. Here we shall adopt the effective volumetric ratio determined by the effective compression ratio of the fresh gases.

Maximum performance in internal combustion piston engines is generally recorded at full load, that is to say at wide-open throttle at the speed or range of speeds at which the mean effective pressure of the engine cycle is at its maximum value.

For each engine, these operating conditions correspond to a defined power and a defined speed. What this amounts to is that as soon as the work demanded of an engine no longer corresponds to these power and speed conditions, its performance drops.

The main characteristic of engines which defines the power and speed at which maximum performance is found is their volumetric displacement.

In everyday use, particularly in the field of motor vehicles, the engine operating conditions which give rise to optimal performance are rarely united. This is because the volumetric displacement of engines is constant and the power demanded of them by the driver varies considerably.

In general practice, the further the working conditions imposed on the engine by the driver are from its maximum-performance conditions, the poorer its performance.

In low-power use, for example when travelling through town, for the same amount of work, engines with a large volumetric displacement consume more energy than engines with a large volumetric displacement [sic], because they are operating further from their maximum-performance operating conditions. The drawbacks of engines with a large volumetric displacement may become an advantage when the conditions of use require high power, for example on high-speed freeways.

In any event, engine power is altered mainly by changing their speed using a gearbox and changing their load using the throttle which controls the inlet pressure by throttling and modifies the degree of filling of the cylinder(s) and the mean effective pressure for the engine cycle.

Another characteristic of engines determines their overall performance and this is their volumetric ratio. The latter is defined by the relationship between the volume of the cylinder and the volume of the combustion chamber. This ratio is fixed and is calculated to take account of the maximum load conditions of the engine and of the fuel used although at part load, or when the cylinder is insufficiently filled at high speeds, this ratio could be significantly increased in order to improve engine performance.

While the advantage of adapting the volumetric displacements of engines to suit the work demanded of them is clear, their is currently practically no effective device which allows engines, particularly motor vehicle engines, to achieve this result.

Experiments have, however, been performed on devices which, in particular, envisage disengaging or passivating a number of cylinders on multicylinder engines.

None of these devices, on account of the impracticalities of implementing them and of their relative effectiveness, has been considered worthy of being produced in any number.

While it is advantageous, in order to maintain optimum performance, for the volumetric ratio of engines to be adapted to suit the filling of their cylinder(s), particularly at high speeds, no device yet provides a relevant solution for obtaining such a result.

It is to significantly improve the overall performance of internal combustion piston engines, given the varying context in which they are used, that the device according to the invention envisages that any engine equipped therewith should exhibit specific features which distinguish it from an engine as defined according to the rules of the prior art.

SUMMARY OF THE INVENTION

The invention therefore provides for a device for varying an effective volumetric displacement and/or an effective volumetric ratio of an engine which comprises a piston and a cylinder, the device comprising a first device for controlling the effective volumetric ratio of the engine by modifying a starting point of a stroke of the piston with respect to the cylinder, and a second device for controlling the effective volumetric displacement of the engine by discharging into an inlet pipe excess gases let into the cylinder of the engine. The first device may be adapted for controlling the effective volumetric ratio of the engine without modifying a length of the stroke. The first device may be adapted to adjusting the length of a piston upstroke. The first device may comprise a system of gears. The system of gears may comprises a first rack arranged on a lower part of the piston, the rack being held in a guide system which allows the rack to move longitudinally, and a second rack disposed in an engine block of the engine, the second rack being movably longitudinally. The system of gears may further comprise a device for controlling the position of the second rack, and a gear mounted on a connecting rod which is coupled to a crankshaft. The gear may be positioned between the first and second racks.

The second device may further comprise an additional inlet valve, and a device for controlling the opening and closing of the inlet valve. The device for controlling the opening and closing of the additional inlet valve may be adapted to modify an angular offset of a point at which the inlet valve opens and closes. The second device may comprise a device for controlling the opening and closing of an intake valve. The device for controlling the opening and closing of the intake valve may be adapted to modify an angular offset of a point at which the intake valve opens and closes. The device which controls the opening and closing of the additional inlet valve may comprise a camshaft which is coupled to a device which controls an angular offset with respect to a crankshaft. The device which controls the opening and closing of the intake valve may comprise an additional camshaft coupled to a device which controls an angular offset with respect to a crankshaft. The additional camshaft may be coupled to the intake valve via a mechanical linkage. The device for controlling the opening and closing of the inlet valve may further comprise a movable intermediate pulley. The device for controlling the opening and closing of the inlet valve may comprise an intermediate pulley and one of a timing belt or a timing chain, and wherein the intermediate pulley which adjusts a length of one of the timing belt or the timing chain.

The device may further comprise a device which controls a position of the second rack. The device which controls a position of the second rack may comprise an actuator. The actuator may comprise a hydraulic actuator which is coupled to the second rack via a mechanical linkage. The device for controlling the opening and closing of the inlet valve may comprise an actuator which controls the position of the intermediate pulley. The actuator may comprise a hydraulic actuator. The gear may have a truncated profile. The gear may have teeth which transmit movement between the piston and the connecting rod. The gear may be constantly centered between the first and second racks. The piston may comprise a shortened piston having piston rings and no piston skirt.

The first device may comprise a hydraulic actuator comprising a rod and an actuator piston, the hydraulic actuator being adapted to maintain a volume of fluid displaced as a function of a stroke of the actuator piston. The device may further comprise a control mechanism adapted to allow the rod to be displaced into a determined position or kept in a determined position with respect to a body of the hydraulic actuator. The first device may comprise a hydraulic actuator mounted on a block of the engine, wherein the hydraulic actuator further comprises an actuator cover, an actuator piston, an actuator rod, and an actuator rod extender. The hydraulic actuator may be adapted to move the second rack longitudinally. The hydraulic actuator may further comprise a control mechanism utilizing a control rod having a shoulder and being movable longitudinally, the control rod being positioned parallel to the actuator rod and passing through the actuator cover, the actuator body and the actuator piston via orifices formed in the actuator cover, actuator body and actuator piston. The hydraulic actuator may further comprise at least two valves housed in a duct and disposed longitudinally and eccentrically and formed in the actuator piston, the at least two valves being adapted to allow or prevent a flow of hydraulic fluid between an actuator upper chamber and an actuator lower chamber. The at least two valves may include rings which can slide around the control rod, wherein the rings have an inside diameter which is smaller than a diameter of the shoulder of the control rod, and wherein hydraulic actuator further comprises a nonreturn valve which is housed in a hydraulic-fluid inlet duct. The actuator piston may have a cavity on a cylindrical surface facing an orifice of the hydraulic-fluid inlet duct opening into a central part of the actuator body, the cavity being of a height at least equivalent to a maximum stroke of the actuator piston and being connected to the duct disposed longitudinally and eccentrically and formed in the actuator piston connecting upper and lower circular surfaces of the actuator piston, via a connecting passage. The nonreturn valve may comprise a ball held on a seating surface by a spring, wherein the ball is adapted to close an orifice. The orifice which opens into the central part of the actuator body may be connected to a pressurized hydraulic circuit which lubricates the engine. The hydraulic actuator may comprise rubber O-ring seals. The shoulder of the control rod may center the control rod in the eccentric longitudinal duct formed in the actuator piston, the shoulder having one of grooves or slots for allowing fluid to flow along the duct.

The invention also provides for a device for controlling the volumetric ratio of an engine which comprises an engine block, a piston, a cylinder, and a connecting rod, the device comprising a first rack comprising teeth and being coupled to the piston, a second rack comprising teeth and being movable with respect to the engine block, a device for moving the second rack, and a gear comprising teeth and being movably mounted to the connecting rod, wherein the teeth of the gear are adapted to engage the teeth of each of the first and second racks.

Thus, the device according to the invention, in a particular embodiment, displays the following advantages:

In order to remain at optimum performance, the engine automatically adapts its volumetric displacement to the work demanded of it, taking account of the speed conditions imposed on it.

When associated with a supercharging device, the engine may be of a smaller size than a conventional engine while at the same time maintaining a high power, and this may be achieved without detriment to the performance at part load.

When its cylinder(s) is(are) poorly filled, particularly at high speed, the engine adapts its volumetric ratio to said filling conditions in order to optimize its performance, i.e. it optimizes its effective compression ratio according to the speed.

The maximum power of the engine is increased particularly by improving the filling of its cylinder(s) at high speed.

The engine performance is increased significantly over most of its power range.

The maximum performance of the engine may be obtained over a broader speed range.

The pumping losses are reduced over most of the engine power range.

The low idle speed can be lowered thanks to the reduction in residual burnt gases.

The engine can run with downgraded performance to allow the catalytic converter used in the exhaust for treating pollutants to be heated up quickly.

Piston/cylinder friction is reduced by virtue of the method for guiding the piston longitudinally.

The speed has less of an effect on the friction.

The mechanical parts are particularly compact and their speed, with the exception of that of the piston, is low.

The ovalization of the cylinder(s) through wear is reduced because of the absence of side thrust on the piston due to the obliqueness of the connecting rod.

Furthermore, the device according to the invention in particular envisages that:

At low volumetric displacement, the engine cycle will use an expansion stroke which is longer than the stroke used to compress the gases, the expansion diagram then being cut off later than on an engine as defined in the prior art and with the same volumetric displacement.

At low volumetric displacement, the time needed to compress the gases is shorter, and this limits the time that the gases spend confined and is of benefit with regard to the initiation of undesirable detonation effects.

To achieve these results, the device according to the invention comprises, according to a first characteristic:

A system for controlling the volumetric ratio of the engine while it is running. The system works by modifying the starting point of the piston travel with respect to the cylinder without modifying the length of said stroke.

A system for controlling the effective volumetric displacement of the engine. The system works by discharging into the inlet pipe some of the gases let into the cylinder of the engine by the participation of an additional inlet valve. During operation with reduced volumetric displacement, closure of the additional inlet valve can be retarded significantly so that during its upstroke in the cylinder the piston discharges the excess gases let in and so that the start of compression of the gases takes place later in the upstroke of the piston. According to an alternative form of the device according to the invention, the inlet valve as defined according to the prior art may itself be used for this task, by controlling its opening and closing diagrams.

This device according to the invention comprises, in particular, for one cylinder:

A piston equipped with a rack mounted as an integral part of its lower part, said rack constituting one of the parts of a gearing system and being held in a guide system which allows it a longitudinal translational movement.

A control rack mounted in a cavity or on a guide formed in the engine block which allow it a longitudinal translational movement, the position of said control rack being controlled by a control device.

A connecting rod mounted freely on the engine crankshaft which, at its upper part, has a freely mounted gear, said gear constituting the element which transmits movement between the piston and said connecting rod.

An additional inlet valve, whose camshaft, which controls its opening/closure, is slaved to a device which controls its angular offset with respect to the engine crankshaft, this making it possible to modify the angular offset of the point at which said valve closes and opens with respect to the crankshaft.

According to one particular embodiment, its operation requires:

Probes transmitting various engine operating parameters;

One or more computers or devices which process said parameters;

A control device which allows the position of the control rack to be altered according to the result of the processing of the parameters from said probes;

A slaving device which allows the angular offset of the camshaft controlling the opening of the additional inlet valve to be altered according to the result of the processing of the parameters from said probes.

Finally, the device according to the invention comprises:

A piston which, in its lower part, is integral with a rack and which fulfills the same function as the piston of any engine as defined according to the rules of the prior art. The only difference is the way in which movement is mechanically transmitted to the crankshaft;

A connecting rod mounted freely on the crankshaft which fulfills the same function as the connecting rod of any engine as defined according to the rules of the prior art. The only difference is the way in which it is mechanically connected to the piston;

A gear mounted freely at the upper end of the connecting rod and which is slaved to the movement of the piston via the gearing system which it forms with the rack integral with the lower part of said piston, on the one hand, and with the control rack mounted in a cavity or on a guide, formed in the engine block and held in position by its control device, on the other hand. The gear is designed to form the member which transmits movement between the piston and the connecting rod;

A control device which allows the position of the control rack to be altered, and which comprises:

At least one hydraulic actuator or any other system which allows a translational movement to be imparted to the control rack and which is secured to said control rack by any mechanical linkage whatsoever;

At least one hydraulic actuator or any other system capable of forming a device which controls the angular offset of the camshaft which controls the opening of the additional inlet valve, it being possible for said hydraulic actuator, according to a particular embodiment and by way of nonlimiting example, to alter the position of an additional pulley thus varying the length of belt or chain between the pulley of the camshaft of the engine inlet and exhaust valves as defined in the prior art, and the pulley of the camshaft of the additional inlet valve;

And a device which controls the angular offset of the camshaft controlling the opening of the additional inlet valve and which does not necessarily act on the camshaft controlling the engine inlet and exhaust valves as defined according to the rules of the prior art.

In order to minimize the cost of producing an engine with variable volumetric displacement and to minimize the power consumption of the control device making it possible to alter the position of the control rack, this control device, according to a particular embodiment, displays the following advantages:

The control rack is moved and constantly kept in the desired position without the use of a hydraulic pump;

The position of the control rack and therefore the volume of the engine combustion chamber may be controlled using a very low-power slaving device;

Any transfer of hydraulic fluid needed for any change in position of the control rack is performed without the use of an auxiliary hydraulic pump. According to the invention, the hydraulic actuator used to perform any change in position of said control rack itself performs said transfers and in order to do so makes use of the constant changes in the direction of the force to which it is subjected;

The position of the control rack is corrected automatically and constantly while the engine is running;

The device is particularly robust and simple to produce; furthermore it only calls upon production techniques which are well known from the prior art;

The control device in particular envisages that:

The control of the position of the control rack is accurate enough to allow accurate control of the volumetric ratio of the engine;

The accuracy with which the position of the control rack is controlled deteriorates little throughout the life of the engine, and any leaks of hydraulic fluid are automatically and constantly compensated for.

In order to achieve these results, the control device for altering the position of the control rack comprises:

An actuator body mounted so that it is stationary with respect to the engine block parallel to the control rack;

An actuator cover mounted so that it is stationary with respect to the actuator body;

An actuator piston, an actuator rod and an actuator rod extender which are assembled with the control rack, which constitute the upper system for guiding said engine control rack and which can move longitudinally with respect to the actuator body;

A control rod positioned parallel to the actuator rod comprising a shoulder and able to move longitudinally, said control rod passing right through the actuator cover, the actuator body and the actuator piston by virtue of orifices formed in said actuator cover, actuator body and actuator piston;

Valves housed in a duct formed in the mass of the actuator piston, allowing or preventing the flow of hydraulic fluid between the actuator upper and lower chambers as defined by the position of the actuator piston relative to the actuator body;

A nonreturn valve housed in a hydraulic-fluid inlet duct, the orifice of which opens into the central part of the actuator body, said nonreturn valve allowing hydraulic fluid to enter the actuator body but preventing it from leaving this body;

Springs keeping the various valves in contact with their seats;

Sealing devices which may, in a particular embodiment of the invention, consist of rubber O-rings.

According to one particular embodiment, its operation requires one or more low-power slaving mechanisms for altering the longitudinal position of the control rod with respect to the actuator body, taking the dictates of the operation of the engine into account.

The control device for altering the position of the control rack comprises:

An eccentric longitudinal duct which is formed in the mass of the actuator piston and which connects the lower and upper circular surfaces of said actuator piston. The duct is formed in such a way that it constitutes a housing for the two valves which allow or prevent the flow of hydraulic fluid. The duct is of a larger diameter than the valves so as to allow fluid to flow along said duct when said valves are open;

An eccentric longitudinal duct which is formed in the mass of the actuator piston and which provides the control rod with longitudinal guidance;

An actuator piston which has a cavity on its cylindrical surface facing the hydraulic fluid inlet orifice opening into the central part of the actuator body. The cavity has a height at least equivalent to the maximum stroke of the actuator piston and is connected to the eccentric longitudinal duct formed in the mass of the actuator piston;

Valves which allow or prevent the flow of hydraulic fluid between the actuator upper and lower chambers as defined by the position of the actuator piston relative to the actuator body. The valves consist of rings which can slide around the control rod. The inside diameter of the valves is smaller than the diameter of the shoulder of the control rod. When the valves are not held open by the shoulder of the control rod they are held on their seats by springs;

A shoulder on the control rod which centers said control rod in the eccentric longitudinal duct formed in the mass of the actuator piston. The shoulder allows one or other of the valves which allow or prevent the flow of hydraulic fluid between the actuator upper and lower chambers to be moved. The shoulder is provided with grooves or slots to allow fluid to flow along the duct;

A nonreturn valve which is housed in the hydraulic-fluid inlet duct, the orifice of which opens into the central part of the actuator body and which, according to one particular embodiment, may consist of a ball held on a seating surface by a spring and closing an orifice;

A hydraulic-fluid inlet duct, the orifice of which opens into the central part of the actuator body and which, according to a particular embodiment, may be connected to the pressurized hydraulic circuit which lubricates the variable-displacement engine.

The device according to the invention for allowing the effective volumetric displacement and/or the effective volumetric ratio of a piston engine to be varied while it is running comprises:

A first device for controlling the volumetric ratio of the engine by modifying the starting point of the stroke of the piston with respect to the cylinder without modifying the length of said stroke;

And a second device allowing the effective volumetric displacement of the engine to be controlled by discharging into the inlet pipe excess gases let into the cylinder of the engine and by adjusting the length of the piston upstroke used for compressing the gases.

The device according to the present invention comprises a first device for controlling the volumetric ratio of the engine, which consists of a system of gears which comprises:

A rack integral with the lower part of the piston and which is held in a guide system allowing said rack a longitudinal translational movement;

A control rack guided in longitudinal translation in the engine block;

A device for controlling the position of the control rack;

And a gear mounted freely on a connecting rod which is also free on a crankshaft so that the gear is positioned between the two racks to form the element which transmits movement between the piston and the connecting rod.

The device according to the present invention comprises a second device controlling the effective volumetric displacement of the engine consisting of an additional inlet valve and of a device which controls its opening/closure and which allows the angular offset of the point at which said valve opens and closes with respect to the crankshaft to be modified.

The device according to the present invention comprises a second device for controlling the effective volumetric displacement of the engine, without an additional inlet valve, consisting of a device which controls the opening and closure of an inlet valve known per se and which allows the angular offset of the point at which said valve closes and opens with respect to the crankshaft to be modified.

The device according to the present invention comprises a device controlling the opening and closure of the additional inlet valve which is a camshaft slaved to a device which controls its angular offset with respect to the engine crankshaft.

The device according to the present invention comprises a device controlling the opening and closure of the inlet valve known per se which consists of an additional camshaft slaved to a device which controls its angular offset with respect to the engine crankshaft, said additional camshaft operating said valve via a mechanical linkage which is in addition to the movement imparted to said valve by its camshaft.

The device according to the present invention comprises a device controlling the angular offset of the camshaft controlling the opening of the additional inlet valve which consists of an intermediate pulley, the position of which defines the length of the timing belt or chain between the pulley of the camshaft for the engine inlet valves and exhaust valves and the pulley of the camshaft which opens the additional inlet valve.

The device according to the present invention comprises a device controlling the position of the control rack which consisting of a hydraulic actuator which acts on said rack via a mechanical linkage.

The device according to the present invention comprises a device which controls the position of the intermediate pulley consisting of a hydraulic actuator.

The device according to the present invention comprises a gear which has a truncated profile so that it retains only those teeth which will be useful in transmitting movement between the piston and the connecting rod.

The device according to the present invention comprises bearing surfaces which are formed respectively the gear and the racks to allow said gear to be constantly centered between said racks, while the point of contact between said bearing surfaces is constantly positioned at the pitch-circle diameter of the gear.

The device according to the present invention comprises a piston, the cylindrical part of which is tall enough to house piston rings but has no skirt for its longitudinal guidance.

The device for varying the effective volumetric displacement and/or the effective volumetric ratio of a piston engine comprises a device for controlling the position of the control rack which comprises:

A hydraulic actuator comprising means for extending its rod allowing it to maintain a volume of fluid displaced as a function of the stroke of the actuator piston which is identical for each of the chambers—upper and lower—of said actuator.

Control mechanisms which allow the rod of the actuator to be displaced into a determined position or kept in a determined position with respect to the body of the actuator.

The device according to the present invention comprises a control device which comprises:

An actuator body mounted so that it is stationary with respect to the engine block, parallel to the control rack, an actuator cover mounted so that it is stationary with respect to the actuator body, an actuator piston, an actuator rod and an actuator rod extender which are assembled with the control rack, which constitute the upper system for guiding said control rack and which can move longitudinally with respect to the actuator body, Control mechanisms which consist of a control rod which has a shoulder and which can move longitudinally, said control rod being positioned parallel to the actuator rod and passing right through the actuator cover, the actuator body and the actuator piston via orifices formed in said actuator cover, actuator body and actuator piston, of valves housed in a duct placed longitudinally and eccentrically and formed in the mass of the actuator piston, said valves allowing or preventing the flow of hydraulic fluid between the actuator upper and lower chambers as defined by the position of the actuator piston relative to the actuator body, said valves consisting of rings which can slide around the control rod, and their inside diameter being smaller than the diameter of the shoulder of the control rod so that it is possible to hold them open using said shoulder of said control rod, when said valves are not held open by said shoulder of said control rod, they are kept on their seats by springs and a nonreturn valve which is housed in a hydraulic-fluid inlet duct, the orifice of which opens into the central part of the actuator body, said nonreturn valve allowing hydraulic fluid to enter the actuator body but preventing it from leaving this body.

The device according to the present invention comprises a control device which comprises an actuator piston which has a cavity on its cylindrical surface facing the orifice of the hydraulic-fluid inlet duct opening into the central part of the actuator body, said cavity being of a height at least equivalent to the maximum stroke of said actuator piston and being connected to the duct placed longitudinally and eccentrically and formed in the mass of said actuator piston connecting the upper and lower circular surfaces of said actuator piston, via a connecting passage.

The device according to the present invention comprises a control device which comprises a nonreturn valve consisting of a ball held on a seating surface by a spring and closing an orifice.

The device according to the present invention comprises a control device which comprises a hydraulic-fluid inlet duct, one of the orifices of which opens into the central part of the actuator body and which is connected to the pressurized hydraulic circuit which lubricates the variable-displacement engine.

The device according to the present invention comprises a control device which comprises sealing elements consisting of rubber O-ring seals.

The device according to the present invention comprises a control device in which the shoulder centers the control rod in the duct placed longitudinally and eccentrically and formed in the mass of said actuator piston, said shoulder having grooves or slots to allow fluid to flow along said duct.

Other characteristics and advantages of the present invention will become clearer from reading the description which will follow, given in conjunction with the appended drawings.

DETAILED DESCRIPTION OF THE INVENTION

Figure 1:
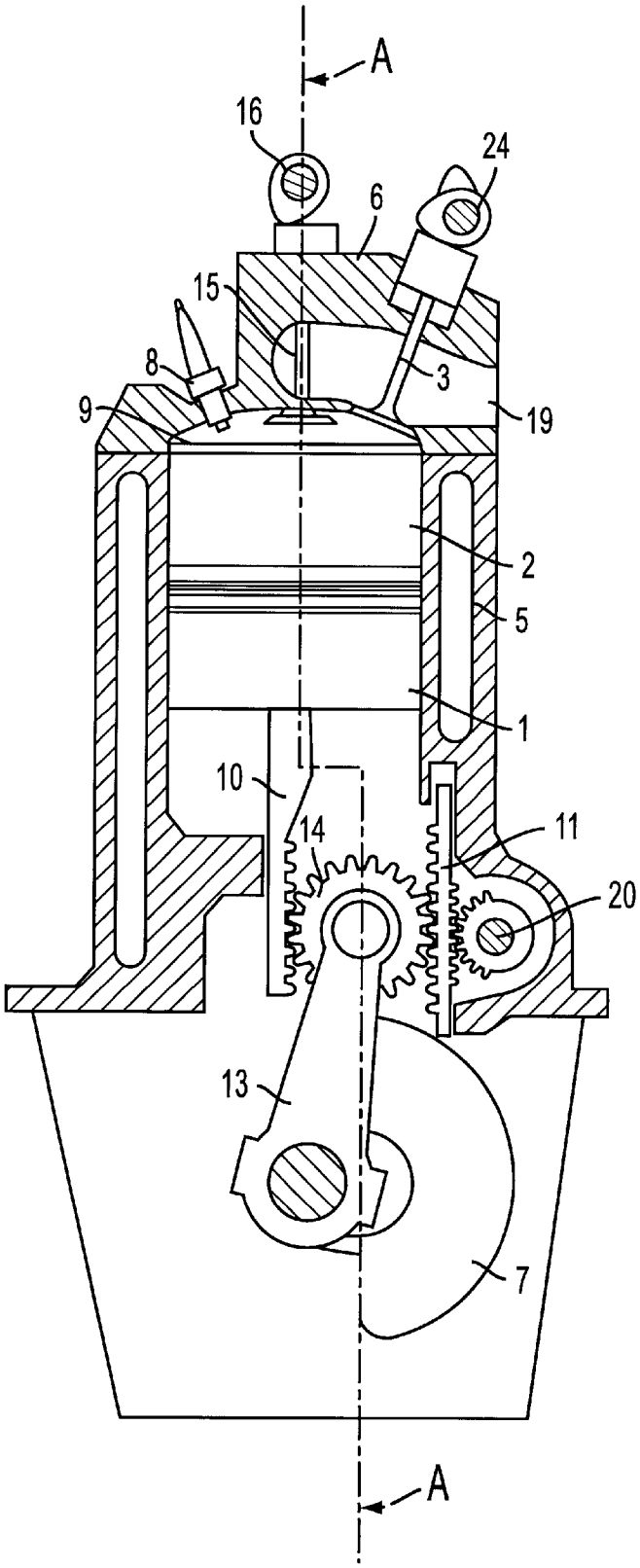
FIG. 1 is a diagrammatic view in cross section of the device according to the invention.
Figure 2:
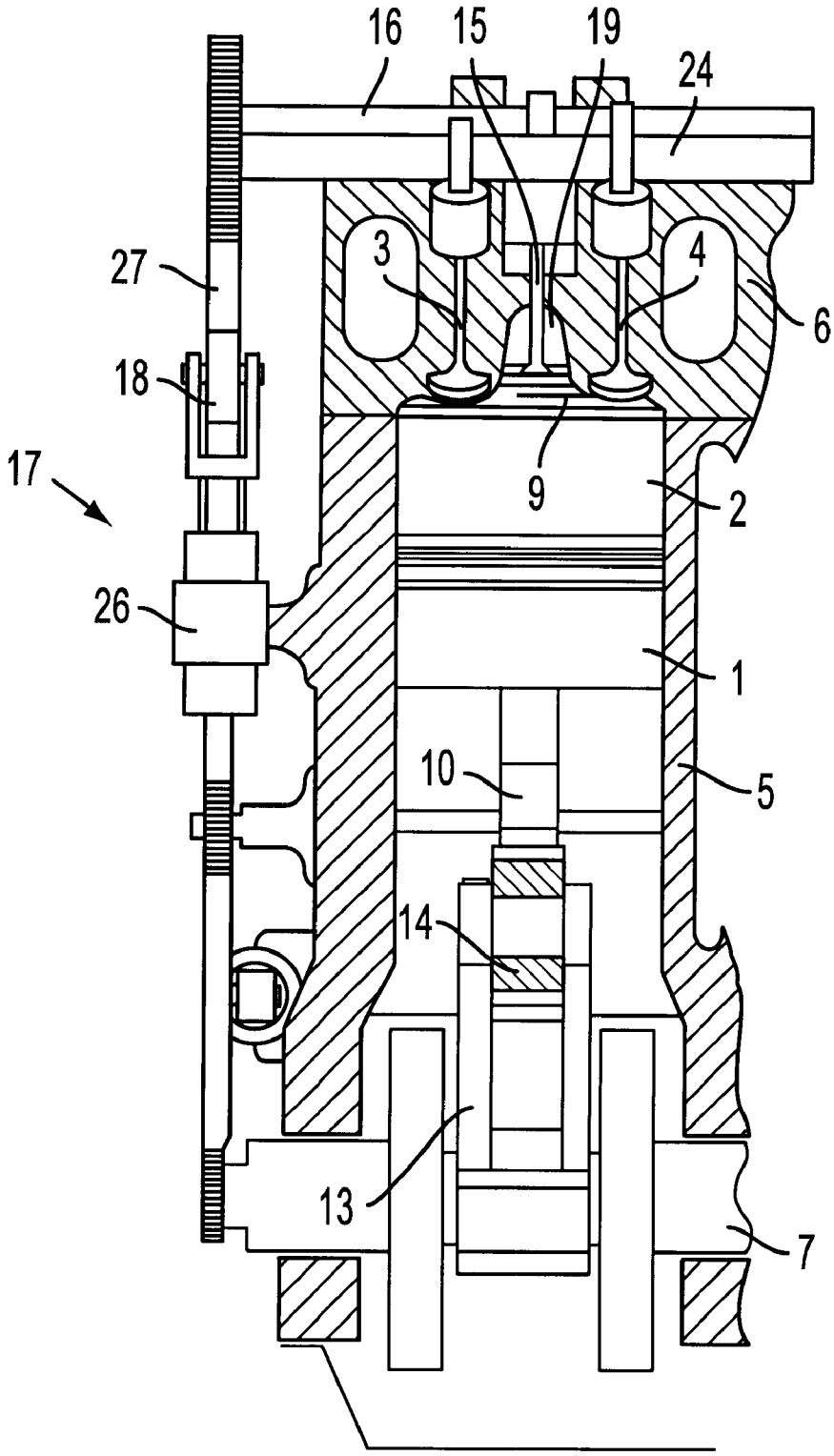
FIG. 2 is a diagrammatic view from the right in section on the line A—A of FIG. 1 of the device according to the invention.

As can be seen in the figures, the device according to the invention is inserted into an environment which is well known from the prior art: piston engines.

FIGS. 1 to 4 show an engine comprising a piston 1, a cylinder 2, valves 3, 4, 15 or 22, an engine block 5, a cylinder head 6, a crankshaft 7, a spark plug 8 and a combustion chamber 9.

According to the invention, the function of these members is unchanged by comparison with the prior state of the art.

The device according to the invention essentially comprises a rack 10 integral with the lower part of the piston 1, a control rack 11 mounted in a cavity or on a guide formed in the engine block 5, a device 12 which controls the position of said control rack with respect to the engine block. It also comprises a connecting rod 13 freely mounted on the engine crankshaft 7 and which, at its upper part, has a freely mounted gear 14.

Figure 5:
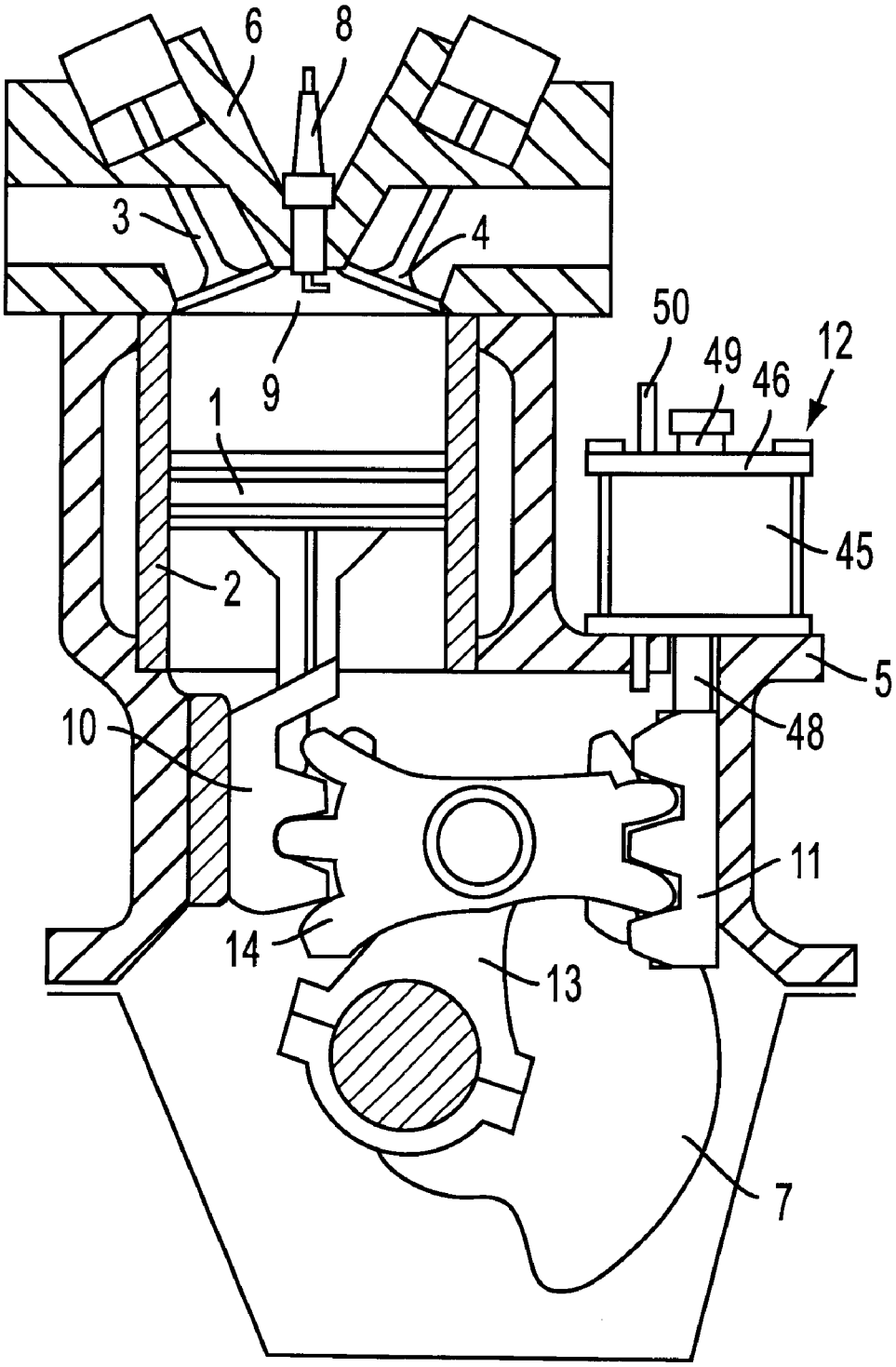
FIG. 5 is an overall view showing the position of the control device according to the invention for altering the position of the control rack with respect to the other elements which make up the variable-displacement engine, and depicting an alternative form of the gearing system.

Note that the cylindrical part of the piston 1 is tall enough to house piston rings but has no skirt for its longitudinal guidance (FIG. 5).

It will be noted that according to one particular embodiment, the gear 14 may have a truncated profile so that it retains only those teeth which will be useful in transmitting movement between the piston 1 and the connecting rod 13 (FIG. 5). Note that bearing surfaces are formed respectively on the gear 14 and on the racks 10, 11, to constantly center said gear between said racks, while the point of contact between said bearing surfaces is constantly positioned on the pitch-circle diameter of the gear 14 (FIG. 5).

The device according to the invention further comprises an additional inlet valve 15, whose camshaft 16 controlling its opening is slaved to a device 17 which controls its angular offset with respect to the engine crankshaft 7.

Figure 3:
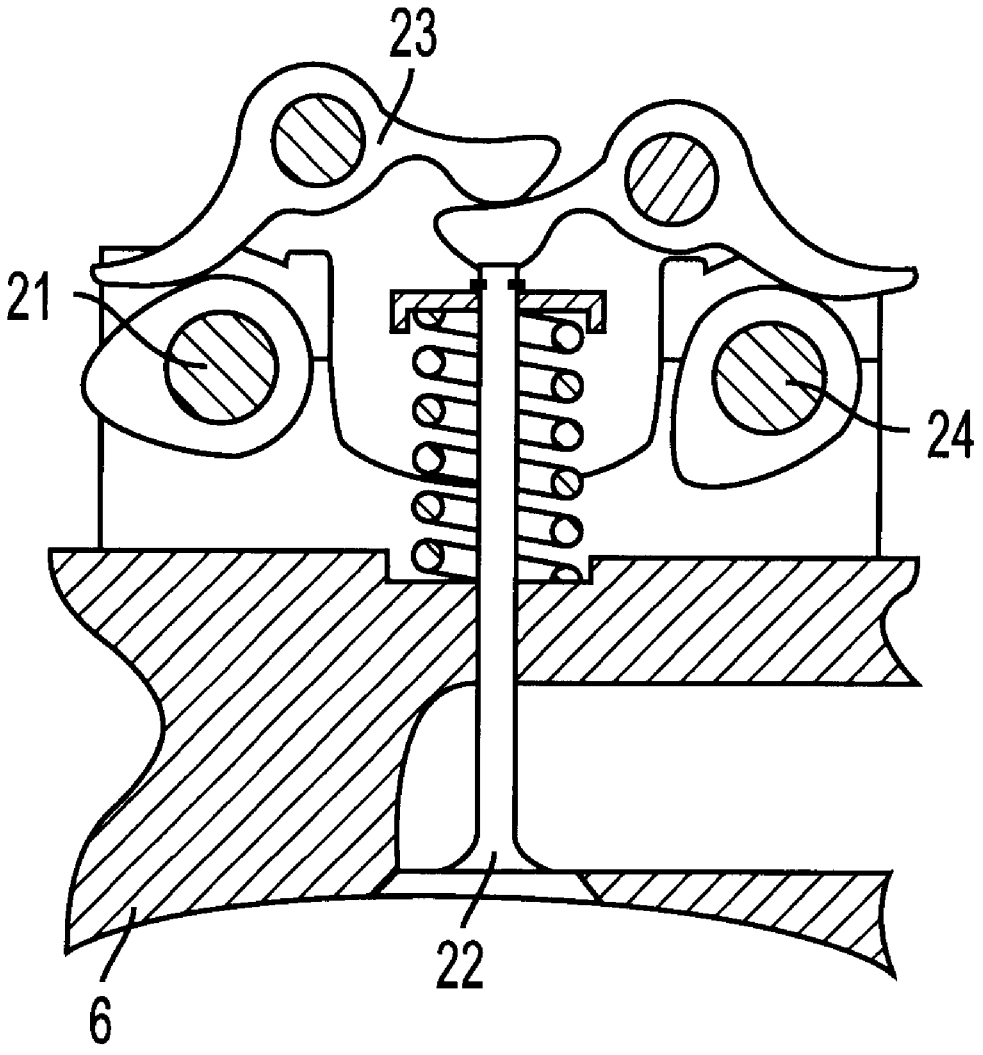
FIG. 3 is a diagrammatic sectioned view of the device for controlling the opening of the inlet valve as defined in the prior art which, according to one alternative form of the device according to the invention, can be used to control the volumetric displacement of the engine.
Figure 4:
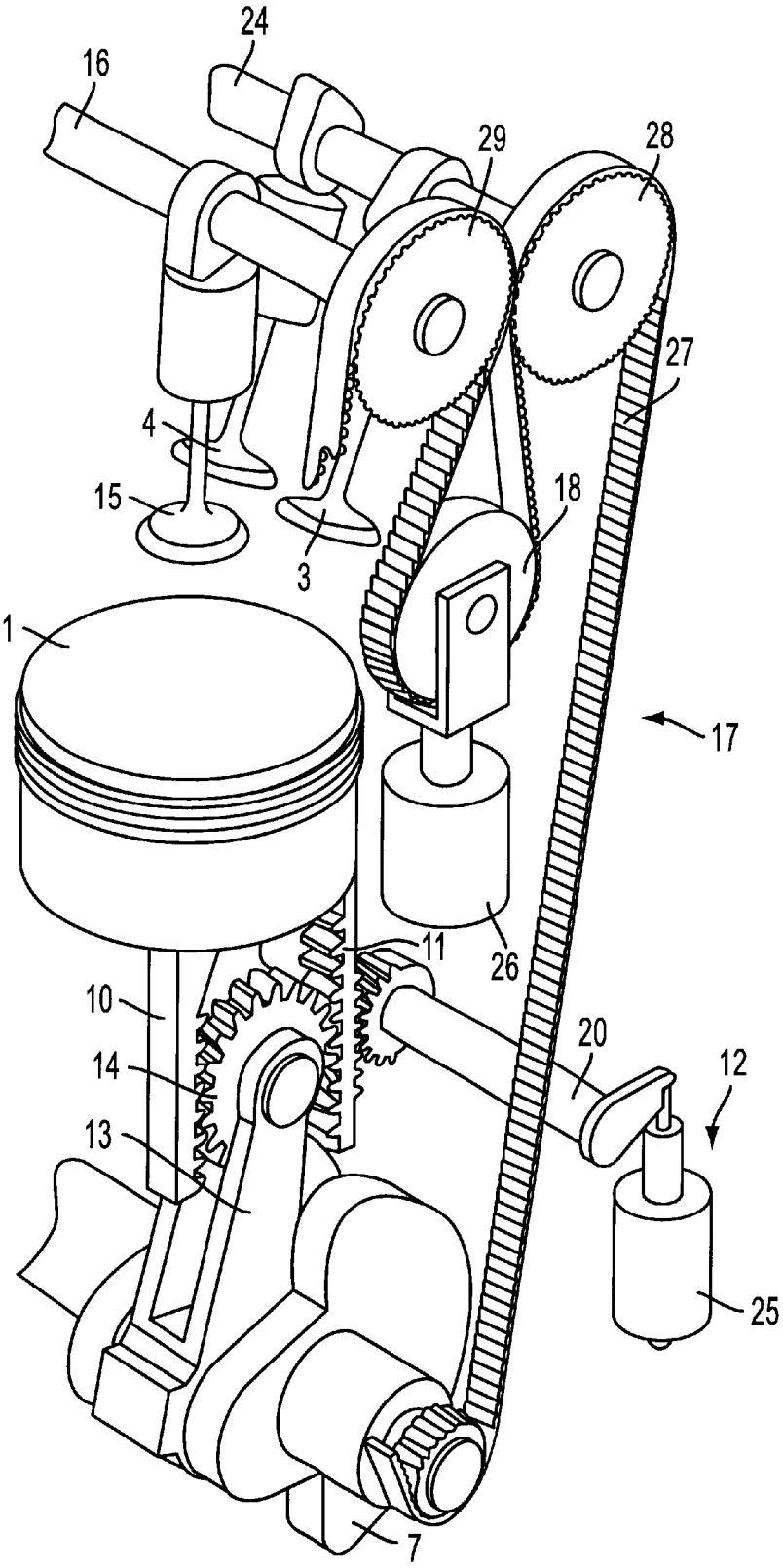
FIG. 4 is a view in perspective demonstrating the layout of the main elements which make up the device according to the invention.

In an alternative form, the function fulfilled by the additional inlet valve 15 may be assumed by the inlet valve 22 as defined according to the prior art, as shown in FIG. 3.

An additional device therefore allows the angular offset of the point at which the valve 22 closes and opens with respect to the crankshaft 7 to be modified. The additional device may comprise an additional camshaft 21 slaved to a device, not depicted, which controls its angular offset with respect to the engine crankshaft. The additional camshaft 21 operates the inlet valve 22 via a mechanical linkage 23 which is in addition to the movement imparted on said valve by its camshaft 24 as defined according to the prior art.

The device according to the invention may also comprise various accessories which have not been depicted, such as probes transmitting various engine operating parameters, one or more computers or devices processing the information from said probes and a system slaving the device 12 which controls the position of the control rack 11 with respect to the engine block 5 and the device 17 which controls the angular offset of the additional inlet valve 15, to the result of the processing of the information from said probes.

The way in which the device for varying the effective volumetric displacement and/or the effective volumetric ratio of a piston engine works is as follows:

The effective volumetric displacement of the engine is modified, while at the same time maintaining an appropriate volumetric ratio, through the combined action of the devices for, on the one hand, controlling the volumetric ratio of the engine and, on the other hand, controlling the effective volumetric displacement of said engine, while the latter is running.

The volumetric ratio of the engine is controlled by controlling the starting position of the stroke of the piston 1 with respect to the cylinder 2, without modifying the length of said stroke.

The effective volumetric displacement of the engine is controlled as follows:

The device 12 for controlling the rack 11 receives the command to move said control rack 11. This command is embodied, for example, by the introduction into a hydraulic actuator 25 of a certain volume of pressurized oil from a pump (not depicted).

The volume introduced is calculated beforehand by the device or devices (not depicted) processing the information from the engine-parameter probes (not depicted). The action of the control device 12 on the control rack 11 via a mechanical linkage 20 has the effect of imparting a translational movement on said control rack 11 parallel to its longitudinal axis.

The control rack 11 constitutes a gearing system with the gear 14 mounted freely in the upper part of the connecting rod 13 and the rack 10 integral with the lower part of the piston 1. The movement of the control rack 11 modifies the starting point of the stroke of the piston 1 with respect to the cylinder 2. Modifying the starting point of the stroke has the effect of modifying the volume of the combustion chamber 9, the length of said stroke being unchanged, and so the volumetric ratio of the engine is modified.

The effective volumetric displacement of the engine is also controlled as follows:

The device 17 which controls the angular offset of the camshaft 16 which controls the opening of the additional inlet valve 15 receives the command to retard or advance the closure of said additional inlet valve 15.

This command is embodied, in one particular embodiment of the control device 17, by the introduction into a hydraulic actuator 26 of a certain volume of pressurized oil from a pump (not depicted).

The volume introduced is calculated beforehand by the device or devices, not depicted, which process the information from the engine-parameter probes (not depicted).

The hydraulic actuator 26 can alter the position of an intermediate pulley 18 which modifies the length of the timing belt 27 or chain between the pulley 28 of the camshaft 24 for the engine inlet 3 and exhaust 4 valves, and the pulley 29 of the camshaft 16 which controls the opening of the additional inlet valve 15.

According to the invention, a calculated retard in closing the additional inlet valve 15 has the effect of allowing the piston 1 to discharge into the inlet pipe 19 a certain amount of fresh gas let in excess, on the one hand, and of using just part of the length of the stroke of the piston 1 for compressing the gases, on the other hand. According to one feature of the invention, in a multicylinder engine, the fresh gases discharged into the inlet pipe 19 can be drawn back into an adjacent cylinder during the inlet phase.

The device according to the invention envisages for the ratio between the volume of the combustion chamber defined by the system which controls the volumetric ratio and the length of piston stroke used to compress the fresh gases not to remain constant, this being so as to allow the engine to work with the highest possible effective volumetric ratio allowed by the operating conditions of said engine.

In operation, the effective volumetric displacement of the engine and its effective volumetric ratio are constantly slaved to the requirements for optimizing engine performance.

Figure 6:
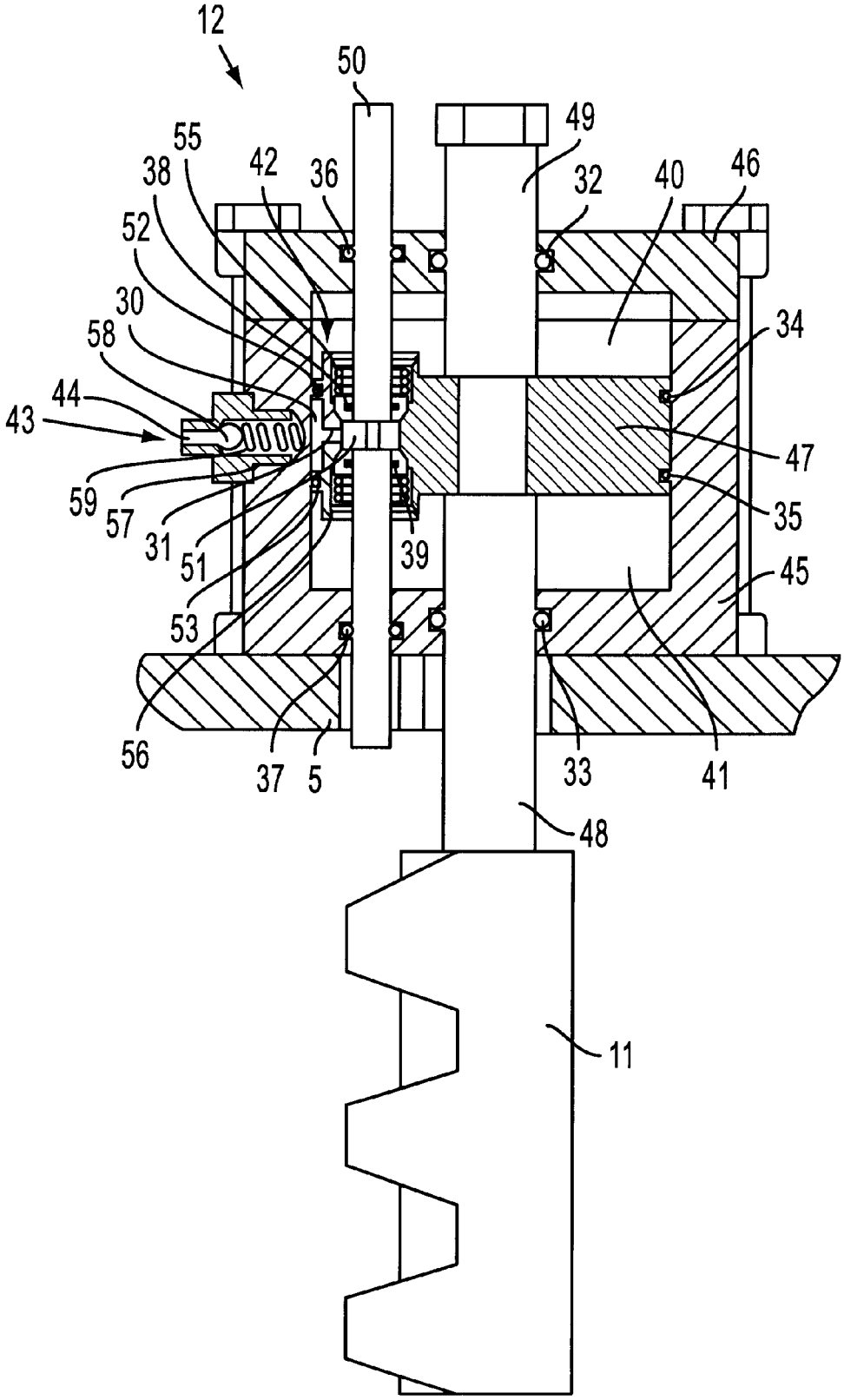
FIG. 6 is a diagrammatic end-on sectioned view of the device for controlling the control rack.
Figure 7:
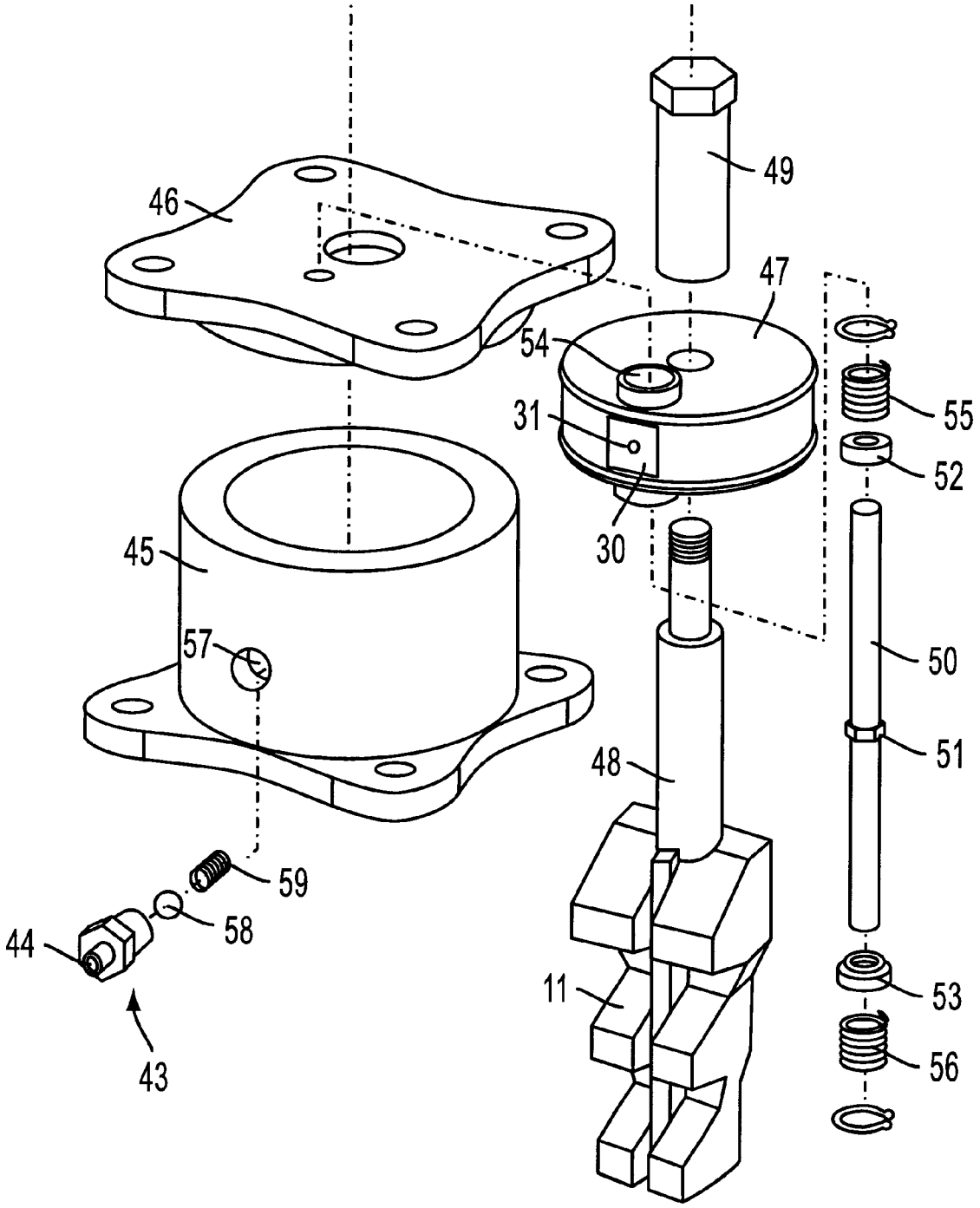
FIG. 7 is a perspective view showing the layout and appearance of the main elements which make up the device for controlling the position of the control rack according to the invention.

FIGS. 5 to 7 show an alternative form of the device 12 which controls the position of the control rack 11 with respect to the engine block 5.

The control device 12 essential comprises an actuator body 45 mounted so that it is stationary with respect to the engine block 5 parallel to the control rack 11, an actuator cover 46 mounted so that it is stationary with respect to the actuator body 45, an actuator piston 47, an actuator rod 48 and an actuator rod extender 49 which are assembled with the control rack 11, which constitute the upper system for guiding said control rack 11 and which can move longitudinally with respect to the actuator body 45.

FIGS. 6 and 7 show the device 12 comprising control mechanism 42 which consist of a control rod 50 with a shoulder 51 and which can move longitudinally.

The control rod 50 is positioned parallel to the actuator rod 48 and passes right through the actuator cover 46, the actuator body 45 and the actuator piston 47 by virtue of ducts formed in said actuator cover 46, actuator body 45 and actuator piston 47.

The control mechanism 42 also consist of valves 52, 53 housed in a duct 54 formed in the mass of the actuator piston 47.

The valves 52, 53 allow or prevent the flow of hydraulic fluid between the actuator upper 40 and lower 41 chambers as defined by the position of the actuator piston 47 relative to the actuator body 45. The valves 52, 53 consist of rings which can slide around the control rod 50. The inside diameter of the rings is designed to be smaller than the diameter of the shoulder 51 of the control rod 50 so that it is possible for them to be kept open by said shoulder 51. When the valves 52, 53 are not kept open by the shoulder 51, they are held on their seats by springs 55, 56.

The control mechanism 42 consist of a nonreturn valve 43 housed in a hydraulic-fluid inlet duct 57, one of the orifices of which opens into the central part of the actuator body 45. The nonreturn valve 43 allows hydraulic fluid to enter the actuator body 45 but prevents it from leaving this body. The valve 43 may, according to a particular embodiment, consist of a ball 58 held on a seating surface by a spring 59 so as to close an orifice 44.

The control mechanism 42 of the device 12 envisage 20 for the actuator piston 47 to have a cavity 30 on its cylindrical surface facing the inlet duct 57 provided in the central part of the actuator body 45. The cavity 30 is of a height at least equivalent to the maximum stroke of the actuator piston 47. The cavity 30 communicates with the duct 54 placed longitudinally and eccentrically so as to connect the lower and upper circular surfaces of the actuator piston 47, via a connecting passage 31.

The control mechanism 42 also envisage for sealing elements, which may consist of rubber O-rings 32, 33, 34, 35, 36, 37, 38, 39 to be provided on the moving parts 49, 48, 47, 50, 52, 53.

The way in which the control device 12 shown in FIGS. 5 to 7 works is as follows:

The position of the control rack 11 is controlled via the control rod 50, the position of which determines the position of the actuator piston 47, by virtue of the action of the two valves 52, 53.

The valves 52, 53 make it possible to control the volume of oil trapped respectively in the upper chamber 40 and in the lower chamber 41 of the hydraulic actuator.

The position of the control rack 11 is controlled as follows:

Obtaining a new position for the control rack 11:

The computer, not depicted, which constantly defines the appropriate height for the control rack 11 according to the engine operating conditions, alters the position of the control rod 50 via a slaving device which may, for example, consist of a low-power electric stepping motor (not depicted). The new position of the control rod 50 with respect to the actuator piston 47 integral with the control rack 11 has the effect of opening the valve 52, 53 located on the same side as the direction of movement of said control rod 50, the valve then being lifted by the shoulder 51.

The frequent change in the direction of the force on the actuator piston 47, which is due to the reciprocating movement of the mechanical parts which make up part of the lower collection of moving parts of the variable-displacement engine gives rise to a pressure which alternately is higher on the top and then higher on the underside of the actuator piston.

When the pressure becomes higher on the same side as the valve 52, 53 which is kept open by the control rod 50, the hydraulic fluid escapes through the orifice which is now open and lifts the valve 52, 53 on the opposite side which is free with respect to the control rod and has been kept closed hitherto by a spring 55, 56. The hydraulic fluid then moves to the opposite side as long as the actuator piston is not in a position such that the control rod is no longer able to keep said open valve open.

If one force-direction-change cycle is not enough to obtain the desired position, and if the actuator piston 47 has not reached a position such that the control rod 50 can no longer keep the open valve 52, 53 open, then one or more further cycles of changing the direction of the force may be necessary. The valve 52, 53, remaining free with respect to the control rod 50 and thus acting as a nonreturn valve preventing the hydraulic fluid stored up on its side from returning to the same side as the valve 52, 53 is kept open by the control rod 50, and remains so until the desired position of the actuator piston 47 with respect to the actuator body 45 is reached.

Keeping the control rack 11 constantly in a defined position:

Small leaks or seepage may occur at the seals 32 to 39, because of the high pressures in the actuator body 45. To keep the control rack 11 in the appropriate position in spite of these hydraulic losses, it is necessary to constantly correct its position with respect to the control rod 50, even by tiny amounts.

This result is obtained through the combined action of the two valves 52, 53 which allow the volume of oil trapped respectively in the upper chamber 40 and in the lower chamber 41 of the hydraulic actuator to be controlled, and of the nonreturn valve 43 housed in the hydraulic-fluid inlet duct 57, the orifice of which opens into the central part of the actuator body 45.

If there is a leak of hydraulic fluid in the upper chamber 40 or lower chamber 41 of the actuator, the respective volumes of which chambers are defined by the position of the actuator piston 47 with respect to the actuator body 45, it then follows, when the pressure on the side of the leaking chamber is high, that there will be movement of the actuator piston 47 toward said leaking chamber which is not authorized by the position of the control rod 50. The consequence of such an unauthorized movement will be that of keeping the valve 52, 53 positioned on the same side as the leaking chamber closed but of opening the valve 52, 53 positioned on the opposite side, this being brought about by the shoulder 51 of the control rod 50 whose position with respect to the actuator piston 47 will no longer be appropriate. The closing and opening of the corresponding valves has the effect of filling the opposite chamber to the leaking chamber with hydraulic fluid let in via the nonreturn valve 43 housed in the duct 57. The hydraulic fluid is conveyed to the opposite chamber 40, 41 to the leaking chamber by virtue of the cavity 30 formed in the cylindrical surface of the actuator piston 47 facing, on the one hand, the orifice of the duct 57 opening into the central part of the actuator body 45 and, on the other hand, the connecting passage 31 which connects said cavity 30 to the duct 54 formed in the mass of the actuator piston 47.

When the direction of the force applied to the actuator piston 47 via the control rack 11 is reversed, the hydraulic fluid let into the opposite chamber 40, 41 to the leaking chamber is discharged toward said leaking chamber until such time as the valve 52, 53 kept open by the shoulder 51 of the control rod 50 rests onto its seat, thus returning the control rack 11 to the correct position.

According to the invention, the position of the control rod 50 therefore constantly governs the position of the control rack 11 with respect to the engine block 5 and therefore the volume of the engine combustion chamber 9. It is thus possible to control the volume of the engine chamber using a very low-power slaving device (not depicted).

It will be seen that, aside from the inherent advantages in the device itself which, according to the invention, allows the effective volumetric displacement and/or the effective volumetric ratio of a piston engine to be varied during operation and allows the overall performance of the engine to be improved when the engine is being used at variable speed and load, the invention also exhibits the advantage of posing no particular feasibility problems. The invention calls upon known and proven methods and techniques.

The present invention is not restricted to the embodiment which has just been described; on the contrary, it can be modified and varied in ways which will be apparent to the person skilled in the art.

What is claimed is:

1. A device for varying an effective volumetric displacement and/or an effective volumetric ratio of an engine which comprises a piston and a cylinder, the device comprising:

a first device for controlling the effective volumetric ratio of the engine by modifying a starting point of a stroke of the piston with respect to the cylinder; and a second device for controlling the effective volumetric displacement of the engine by discharging into an inlet pipe excess gases let into the cylinder of the engine.

2. The device of claim 1, wherein the first device is adapted for controlling the effective volumetric ratio of the engine without modifying a length of the stroke.

3. The device of claim 1, wherein the first device is adapted to adjusting the length of a piston upstroke.

4. The device of claim 1, wherein the first device comprises a system of gears.

5. The device of claim 4, wherein the system of gears comprises:

a first rack arranged on a lower part of the piston, the rack being held in a guide system which allows the rack to move longitudinally; and a second rack disposed in an engine block of the engine, the second rack being movably longitudinally.

6. The device of claim 1, wherein the second device further comprises:

an additional inlet valve; and a device for controlling the opening and closing of the inlet valve.

7. The device of claim 6, wherein the device for controlling the opening and closing of the additional inlet valve is adapted to modify an angular offset of a point at which the inlet valve opens and closes.

8. The device of claim 6, wherein the device which controls the opening and closing of the additional inlet valve comprises a camshaft which is coupled to a device which controls an angular offset with respect to a crankshaft.

9. The device of claim 6, wherein the device for controlling the opening and closing of the inlet valve further comprising a movable intermediate pulley.

10. The device of claim 6, wherein the device for controlling the opening and closing of the inlet valve comprises an intermediate pulley and one of a timing belt or a timing chain, and wherein the intermediate pulley which adjusts a length of one of the timing belt or the timing chain.

11. The device of claim 10, wherein the device for controlling the opening and closing of the inlet valve comprises an actuator which controls the position of the intermediate pulley.

12. The device of claim 11, wherein the actuator comprises a hydraulic actuator.

13. The device of claim 1, wherein the second device comprises a device for controlling the opening and closing of an intake valve.

14. The device of claim 13, wherein the device for controlling the opening and closing of the intake valve is adapted to modify an angular offset of a point at which the intake valve opens and closes.

15. The device of claim 13, wherein the device which controls the opening and closing of the intake valve comprises an additional camshaft coupled to a device which controls an angular offset with respect to a crankshaft.

16. The device of claim 15, wherein the additional camshaft is coupled to the intake valve via a mechanical linkage.

17. The device of claim 1, wherein the piston comprises a shortened piston having piston rings and no piston skirt.

18. A device for varying an effective volumetric displacement and/or an effective volumetric ratio of an engine which comprises a piston and a cylinder, the device comprising:

a first device for controlling the effective volumetric ratio of the engine by modifying a starting point of a stroke of the piston with respect to the cylinder; and a second device for controlling the effective volumetric displacement of the engine by discharging into an inlet pipe excess gases let into the cylinder of the engine, wherein the first device comprises a system of gears comprising:

a first rack arranged on a lower part of the piston, the rack being held in a guide system which allows the rack to move longitudinally; and a second rack disposed in an engine block of the engine, the second rack being movably longitudinally, wherein the system of gears further comprises:

a device for controlling the position of the second rack; and a gear mounted on a connecting rod which is coupled to a crankshaft.

19. The device of claim 18, wherein the gear is positioned between the first and second racks.

20. The device of claim 18, wherein the gear has a truncated profile.

21. The device of claim 18, wherein the gear has teeth which transmit movement between the piston and the connecting rod.

22. The device of claim 18, wherein the gear is constantly centered between the first and second racks.

23. A device for varying an effective volumetric displacement and/or an effective volumetric ratio of an engine which comprises a piston and a cylinder, the device comprising:

a first device for controlling the effective volumetric ratio of the engine by modifying a starting point of a stroke of the piston with respect to the cylinder; and a second device for controlling the effective volumetric displacement of the engine by discharging into an inlet pipe excess gases let into the cylinder of the engine, wherein the first device comprises a system of gears comprising:

a first rack arranged on a lower part of the piston, the rack being held in a guide system which allows the rack to move longitudinally; and a second rack disposed in an engine block of the engine, the second rack being movably longitudinally; and further comprising a device which controls a position of the second rack.

24. The device of claim 23, wherein the device which controls a position of the second rack comprises an actuator.

25. The device of claim 24, wherein the actuator comprises a hydraulic actuator which is coupled to the second rack via a mechanical linkage.

26. A device for varying an effective volumetric displacement and/or an effective volumetric ratio of an engine which comprises a piston and a cylinder, the device comprising:

a first device for controlling the effective volumetric ratio of the engine by modifying a starting point of a stroke of the piston with respect to the cylinder; and a second device for controlling the effective volumetric displacement of the engine by discharging into an inlet pipe excess gases let into the cylinder of the engine, wherein the first device comprises:

a hydraulic actuator comprising a rod and an actuator piston, the hydraulic actuator being adapted to maintain a volume of fluid displaced as a function of a stroke of the actuator piston.

27. The device of claim 26, further comprising a control mechanism adapted to allow the rod to be displaced into a determined position or kept in a determined position with respect to a body of the hydraulic actuator.

28. The device of claim 26, wherein the hydraulic actuator comprises rubber O-ring seals.

29. A device for varying an effective volumetric displacement and/or an effective volumetric ratio of an engine which comprises a piston and a cylinder, the device comprising:

a first device for controlling the effective volumetric ratio of the engine by modifying a starting point of a stroke of the piston with respect to the cylinder; and a second device for controlling the effective volumetric displacement of the engine by discharging into an inlet pipe excess gases let into the cylinder of the engine, wherein the first device comprises:

a hydraulic actuator mounted on a block of the engine, wherein the hydraulic actuator further comprises an actuator cover, an actuator piston, an actuator rod, and an actuator rod extender.

30. The device of claim 29, wherein the hydraulic actuator is adapted to move the second rack longitudinally.

31. The device of claim 30, wherein the hydraulic actuator further comprises a control mechanism utilizing a control rod having a shoulder and being movable longitudinally, the control rod being positioned parallel to the actuator rod and passing through the actuator cover, the actuator body and the actuator piston via orifices formed in the actuator cover, actuator body and actuator piston.

32. The device of claim 31, wherein the hydraulic actuator further comprises at least two valves housed in a duct and disposed longitudinally and eccentrically and formed in the actuator piston, the at least two valves being adapted to allow or prevent a flow of hydraulic fluid between an actuator upper chamber and an actuator lower chamber.

33. The device of claim 32, wherein the at least two valves include rings which can slide around the control rod, wherein the rings have an inside diameter which is smaller than a diameter of the shoulder of the control rod, and wherein hydraulic actuator further comprises a nonreturn valve which is housed in a hydraulic-fluid inlet duct.

34. The device of claim 33, wherein the actuator piston has a cavity on a cylindrical surface facing an orifice of the hydraulic-fluid inlet duct opening into a central part of the actuator body, the cavity being of a height at least equivalent to a maximum stroke of the actuator piston and being connected to the duct disposed longitudinally and eccentrically and formed in the actuator piston connecting upper and lower circular surfaces of the actuator piston, via a connecting passage.

35. The device of claim 34, wherein the orifice which opens into the central part of the actuator body is connected to a pressurized hydraulic circuit which lubricates the engine.

36. The device of claim 33, wherein the nonreturn valve comprises a ball held on a seating surface by a spring, wherein the ball is adapted to close an orifice.

37. The device of claim 36, wherein the shoulder of the control rod centers the control rod in the eccentric longitudinal duct formed in the actuator piston, the shoulder having one of grooves or slots for allowing fluid to flow along the duct.

38. A device for controlling the volumetric ratio of an engine which comprises an engine block, a piston, a cylinder, and a connecting rod, the device comprising:

a first rack comprising teeth and being coupled to the piston;

a second rack comprising teeth and being movable with respect to the engine block;

a device for moving the second rack; and a gear comprising teeth and being movably mounted to the connecting rod, wherein the teeth of the gear are adapted to engage the teeth of each of the first and second racks.

* * * * *